US009343792B2

(12) United States Patent
Perigaud et al.

(10) Patent No.: US 9,343,792 B2
(45) Date of Patent: May 17, 2016

(54) BAND-PASS FILTER THAT CAN BE FREQUENCY TUNED INCLUDING A DIELECTRIC ELEMENT CAPABLE OF CARRYING OUT A ROTATION

(71) Applicants: THALES, Neuilly-sur-Seine (FR); CENTRE NATIONAL DE LA RECHERCHE SCIENTIFIQUE—CNRS, Paris (FR); CENTRE NATIONAL D'ETUDES SPATIALES—CNES, Paris (FR)

(72) Inventors: Aurelien Perigaud, Panazol (FR); Damien Pacaud, Beaumont sur Leze (FR); Nicolas Delhote, Limoges (FR); Olivier Tantot, Limoges (FR); Stephane Bila, Verneuil sur Vienne (FR); Serge Verdeyme, Aixe sur Vienne (FR); Laetitia Estagerie, Tournefeuille (FR)

(73) Assignees: Thales, Neuilly sur Seine (FR); Centre National de Recherche Scientifique—CNRS, Paris (FR); Centre National d'Etudes Spatiales—CNES, Paris (FR)

( * ) Notice: Subject to any disclaimer, the term of this patent is extended or adjusted under 35 U.S.C. 154(b) by 59 days.

(21) Appl. No.: 13/950,670

(22) Filed: Jul. 25, 2013

(65) Prior Publication Data

US 2014/0028415 A1 Jan. 30, 2014

(30) Foreign Application Priority Data

Jul. 27, 2012 (FR) ..... 12 02127

(51) Int. Cl.

| | |
|---|---|
| ***H01P 1/20*** | (2006.01) |
| ***H01P 1/208*** | (2006.01) |
| ***H01P 7/10*** | (2006.01) |

(52) U.S. Cl.

CPC ..... *H01P 1/2084* (2013.01); *H01P 1/2086* (2013.01); *H01P 7/10* (2013.01)

(58) Field of Classification Search

CPC ..... H01P 1/2084; H01P 1/2086; H01P 7/10; H01P 7/105

USPC ..... 333/202, 235

See application file for complete search history.

(56) References Cited

U.S. PATENT DOCUMENTS

| | | | | |
|---|---|---|---|---|
| 6,147,577 | A * | 11/2000 | Cavey | 333/209 |
| 6,946,933 | B2 | 9/2005 | Accatino et al. | |
| 7,705,694 | B2 | 4/2010 | Craig et al. | |

FOREIGN PATENT DOCUMENTS

| | | | |
|---|---|---|---|
| EP | 1575118 | A1 | 9/2005 |
| EP | 1684374 | A1 | 7/2006 |
| JP | 61-136302 | A | 6/1986 |

*Primary Examiner* — Benny Lee

(74) *Attorney, Agent, or Firm* — Baker Hostetler LLP

(57) ABSTRACT

A band-pass filter for microwave is provided that can be frequency-tuned the filter comprising an input resonator comprising a metal input cavity and an input dielectric element, an output resonator comprising a metal output cavity and an output dielectric element, an input excitation means (S1) of elongate shape, an output excitation means of elongate shape, the input resonator and the output resonator being coupled, characterized in that the input dielectric element and the output dielectric element have a recess, the input excitation means penetrates the recess of the input dielectric element the output excitation means penetrates the recess of the output dielectric element, the input dielectric element is capable of carrying out a rotation about an input rotation axis, the rotations of the dielectric elements allowing the modification of the central frequency of the filter.

15 Claims, 9 Drawing Sheets

BAND-PASS FILTER THAT CAN BE FREQUENCY TUNED INCLUDING A DIELECTRIC ELEMENT CAPABLE OF CARRYING OUT A ROTATION

CROSS-REFERENCE TO RELATED APPLICATION

This application claims priority to foreign French patent application No. FR 1202127, filed on Jul. 27, 2012, the disclosure of which is incorporated by reference in its entirety.

FIELD OF THE DISCLOSURE

The present invention relates to the field of frequency filters in the microwave domain, typically frequencies of between 1 GHz and 30 GHz. More particularly, the present invention relates to frequency-tunable band-pass filters.

BACKGROUND OF THE DISCLOSURE

The processing of a microwave, for example received by a satellite, requires the development of specific components allowing the propagation, the amplification and the filtering of this wave.

For example, a microwave received by a satellite must be amplified before being returned to the ground. This amplification is possible only by separating all the frequencies received into channels, each corresponding to a given frequency band. The amplification is then carried out channel by channel. The separation of the channels requires the development of band-pass filters.

The development of satellites and the increased complexity of the signal processing to be carried out, for example a reconfiguration of the channels in flight, has led to the need to use frequency-tunable band-pass filters, that is to say filters for which it is possible to adjust the central filtering frequency widely named the tuning frequency of the filter.

One of the known technologies of tunable band-pass filters in the microwave domain is the use of passive semiconductor components, such as PIN diodes, continuously variable capacitors or capacitive switches. Another technology is the use of MEMS (for microelectromechanical systems) of the ohmic or capacitive type.

These technologies are complex, they consume electrical power and are not very reliable. These solutions are also limited to the level of signal power processed. In addition, frequency tunability results in a significant deterioration in the performance of the filter, such as its quality factor Q.

Furthermore, the technology of filters based on dielectric elements is known. It makes it possible to produce non-tunable band-pass filters.

FIG. 1 describes an example of a filter based on dielectric elements for non-tunable microwaves.

An input excitation means 10 inserts the wave into the cavity; this element is typically a conductive medium such as a coaxial cable (or probe).

The cavity 13 is a closed cavity consisting of metal, typically aluminum or a metal alloy such as Invar.

An output excitation means 11, typically a conductive medium such as a coaxial cable (or probe) makes it possible to take the wave out of the cavity.

The dielectric element 12 is round or square in shape and placed inside the metal cavity 13. The dielectric material is typically zirconia, alumina or barium magnesium tantalate ("BMT").

A filter typically comprises at least one resonator comprising a metal cavity and a dielectric element. A resonance mode of the filter corresponds to a particular distribution of the electromagnetic field which is excited at a particular frequency.

A band-pass filter allows the propagation of a wave over a certain frequency range and attenuates this wave for the other frequencies. This therefore defines a bandwidth and a central frequency of the filter. For frequencies around its central frequency, a band-pass filter has a high transmission and a weak reflection.

In order to increase their selectivity, that is to say their capacity to attenuate the signal outside the bandwidth, these filters may be composed of a plurality of resonators that are coupled together.

The central frequency and the bandwidth of the filter depend both on the geometry of the cavities and of the dielectric elements, and on the coupling together of the resonators as well as the couplings to the input and output excitation means of the filter.

Coupling means are for example apertures or slots which may otherwise be known as irises, electrical or magnetic probes or microwave lines.

The bandwidth of the filter is characterized in different ways depending on the nature of the filter.

The parameter S is a parameter which reports the performance of the filter in terms of reflection and transmission, respectively. S11 or S22 corresponds to a measurement of the reflection and S12 or S21 to a measurement of the transmission.

A filter performs a filtering function. This function may usually be approximated via mathematical models (iterative functions such as Chebychev, Bessel, etc. functions). These functions are usually founded on polynomial ratios.

For a filter performing a filtering function of the Chebychev or generalized Chebychev type, the bandwidth of the filter is determined at equal ripple of the S11 (or S22), for example at 15 dB or 20 dB of reduction of the reflection relative to its out-band level. For a filter performing a function of the Bessel type, the frequency band corresponding to a bandwidth of −3 dB (when S21 crosses S11) is determined to be the pass band.

An example of a characteristic of the parameters S11 and S12 of a filter is illustrated in FIG. 2. The curve 21 corresponds to the reflection S11 in dB of the wave on the filter as a function of its frequency in GHz. The equal-ripple bandwidth at 20 dB of reflection is designated by the numeral 26. The filter has a central frequency $f_c$ corresponding to the frequency of the middle of the bandwidth. The curve 22 of FIG. 2 corresponds to the transmission S12 in dB of the filter as a function of the frequency in GHz. The filter therefore allows to pass a signal of which the frequency is situated in the bandwidth, but the signal is nevertheless attenuated by the losses of the filter.

The tuning of the filter making it possible to obtain a maximum of transmission for a given frequency band may be difficult to achieve and depends on all of the parameters of the filter. It is also dependent on the temperature.

In order to adjust the filter to obtain a precise central frequency of the filter, the resonance frequencies of the resonators of the filter may be very slightly modified with the aid of metal screws, but this method, carried out empirically, is very costly in time and provides only a very slight frequency tunability, typically of the order of a few %. In this case, the objective is not tunability but the obtaining of a precise value of the central frequency, and it is desired to obtain a reduced frequency sensitivity of each resonator with respect to the depth of the screw.

The circular or square symmetry of the resonators simplifies the design of the filter and the selection of the mode (TE for Transverse Electric or TM for Transverse Magnetic) that is propagated in the filter.

U.S. Pat. No. 7,705,694 describes a bandwidth-tunable filter consisting of a plurality of dielectric resonators coupled together, of non-uniform shape radially and uniform shape on an axis z perpendicular to the direction of propagation. Each resonator is capable of carrying out a rotation around the axis z between two positions, which induces a change of value of the width of the bandwidth, typically from 51 Mz to 68 Mz. This device allows tunability on the value of the width of the bandwidth of the filter, but not on its central frequency.

SUMMARY OF THE DISCLOSURE

The object of the present invention is to produce filters that can be tuned with respect to central frequency and that do not have the aforementioned drawbacks.

Accordingly, the subject of the invention is a band-pass filter for microwaves that can be frequency-tuned and has a central frequency, the microwave being propagated on an axis Z, the filter comprising:

an input resonator comprising a metal input cavity and an input dielectric element placed inside the metal input cavity, the input dielectric element being capable of disrupting the resonance mode of the microwave in the metal input cavity, an output resonator comprising a metal output cavity and an output dielectric element placed inside the metal output cavity, the output dielectric element being capable of disrupting the resonance mode of the microwave in the metal output cavity, an input excitation means of elongate shape penetrating the input cavity in order to allow the microwave to penetrate the input cavity, an output excitation means of elongate shape penetrating the output cavity in order to allow the microwave to exit the output cavity, the input resonator and the output resonator being coupled, characterized in that:

the input dielectric element and the output dielectric element have a recess, the input excitation means of elongate shape on the axis Z penetrates the recess of the input dielectric element so that the input dielectric element disrupts the electromagnetic field close to the input excitation means, the output excitation means of elongate shape on the axis Z penetrates the recess of the output dielectric element so that the output dielectric element disrupts the electromagnetic field close to the output excitation means, the input dielectric element is capable of carrying out a rotation about an input rotation axis, the recess being suitable for allowing the rotation of the dielectric element while keeping the input excitation element inside the recess, the output dielectric element is capable of carrying out a rotation about an output rotation axis, the recess being suitable for allowing the rotation of the dielectric element while keeping the output excitation element inside the recess, each dielectric element has a flat shape having a height that is less than a smallest external dimension of a respective dielectric element in a plane perpendicular to a direction along the height of the respective dielectric element by at least a factor of 3, the rotations of the dielectric elements allowing the modification of the central frequency of the filter.

According to one embodiment, the input dielectric element and the output dielectric element are placed respectively substantially at the centre of the input cavity and of the output cavity.

Advantageously, the input dielectric element and output dielectric element are U-shaped.

According to one embodiment, the filter comprises a coupling means suitable for coupling the input resonator and output resonator directly.

According to one embodiment, the filter also comprises at least one intermediate resonator placed in series between the input resonator and the output resonator, comprising an intermediate metal cavity and an intermediate dielectric element placed inside the cavity and capable of disrupting the resonance mode of the microwave in the cavity, each dielectric element having a flat shape having a height less by at least a factor of 3 than the smallest dimension in a plane perpendicular to the direction supporting the height and being capable of carrying out a rotation about an intermediate rotation axis, the filter comprising coupling means suitable for coupling the intermediate resonators in series.

Advantageously, the coupling means are slots.

Advantageously, the dielectric elements have an identical angular position corresponding to an identical rotation, a value of the angle of rotation corresponding to a value of central frequency of the filter.

Advantageously, the rotation axes are parallel with one another.

Advantageously, the rotation axes are perpendicular to the axis Z.

Advantageously, the intermediate dielectric elements are substantially identical.

According to one embodiment, the dielectric elements are secured to respective dielectric rods capable of carrying out a rotation on the corresponding rotation axis.

According to one embodiment, the angles of rotation are variable as a function of the temperature so as to keep the central frequency values constant when there is a variation in temperature.

A further subject of the invention is a microwave circuit comprising at least one such filter.

BRIEF DESCRIPTION OF THE DRAWINGS

Other features, objects and advantages of the present invention will become apparent on reading the following detailed description with respect to the appended drawings given as non-limiting examples and in which:

FIGS. 6A, 6B, 6C, and 6D describes the position of the dielectric elements of the filter described in FIG. 5 for a determined value of rotation angle.

FIGS. 7A, 7B, 7C, 7D describes the position of the dielectric elements of the filter described in FIG. 5 for another determined value of angle of rotation.

Figure 1:
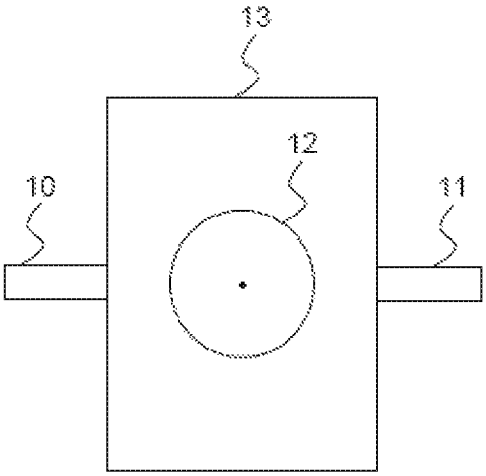
Prior Art FIG. 1
FIG. 1 illustrates an example of a dielectric resonator filter according to the prior art comprising one resonator.
Figure 2:
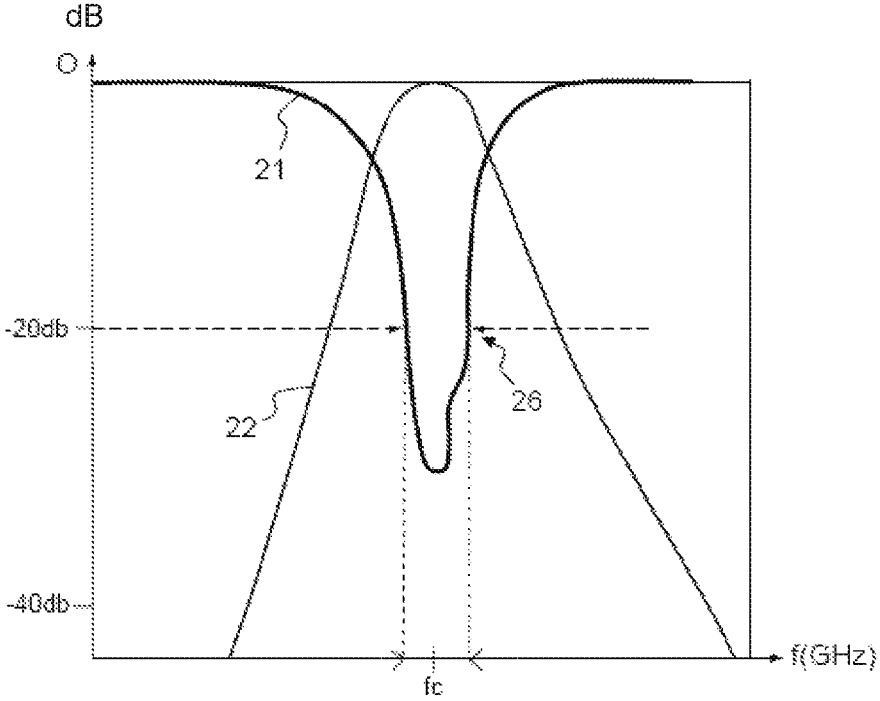
FIG. 2 describes a transmission and reflection curve of a band-pass filter.

Throughout the drawing figures, like features or elements are designated by the same reference labels.

DETAILED DESCRIPTION OF THE PREFERRED EMBODIMENTS

The invention consists in producing a band-pass filter that can have its central frequency tuned by rotation of dielectric elements in metal cavities, the input and output dielectric elements having a specific shape.

The filter according to the invention operates according to a disruptive cavity mode.

Figure 3:
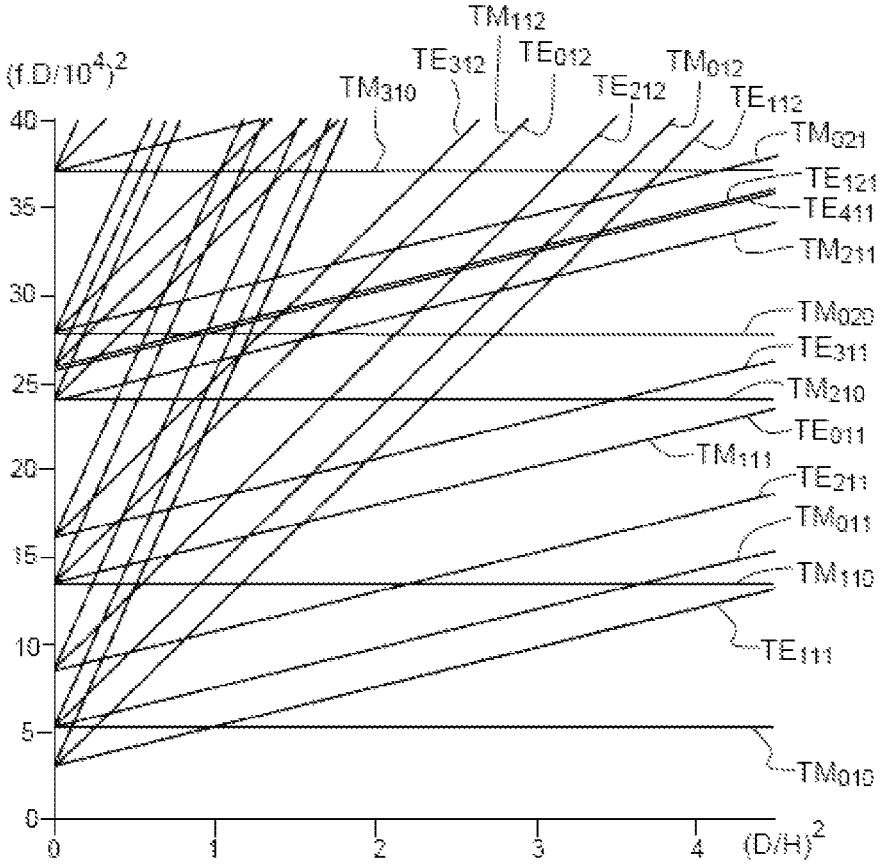
FIG. 3 illustrates the resonance modes of an empty circular cavity.

An empty metal cavity has, depending on its geometry, one or more resonance modes characterized by a frequency f of the microwave that is present in the cavity and by a particular distribution of the electromagnetic field. For example, TE (for Transverse Electric) or TM (for Transverse Magnetic) resonance modes having a certain number of energy maximums indicated by indices, can be excited in an empty metal cavity. FIG. 3 describes, as an example, the various resonance modes (TE/TM) for an empty circular cavity as a function of the dimensions of the cavity (diameter D and height H; i.e. $(D/H)^2$), and of the frequency f (i.e. $(f \cdot D/10^4)^2$).

A cavity containing a dielectric element (called a disrupting element) disrupting the electromagnetic field inside the cavity is also capable of resonating.

Figure 4A:
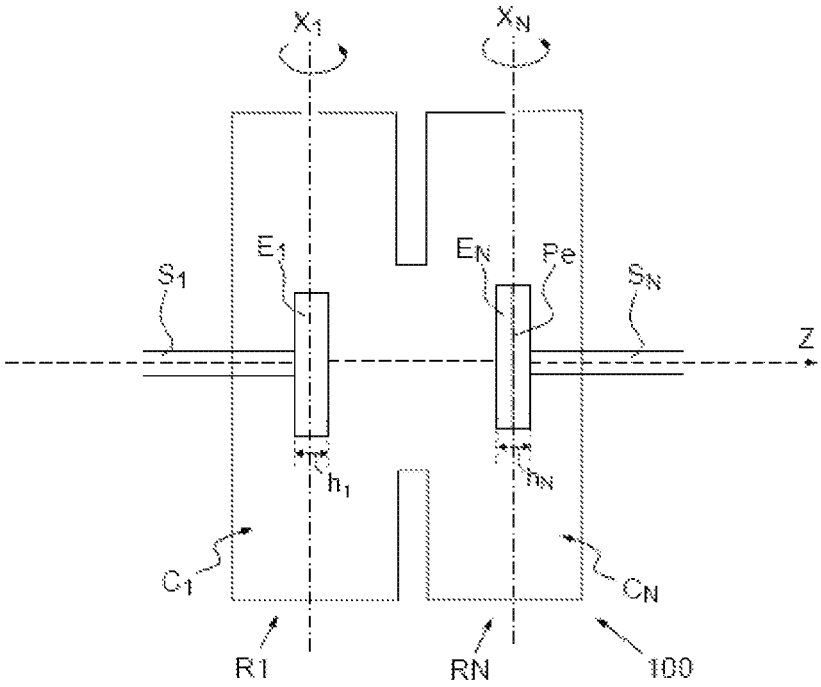
FIGS. 4A and 4B describes a filter according to one aspect of the invention.
Figure 4B:
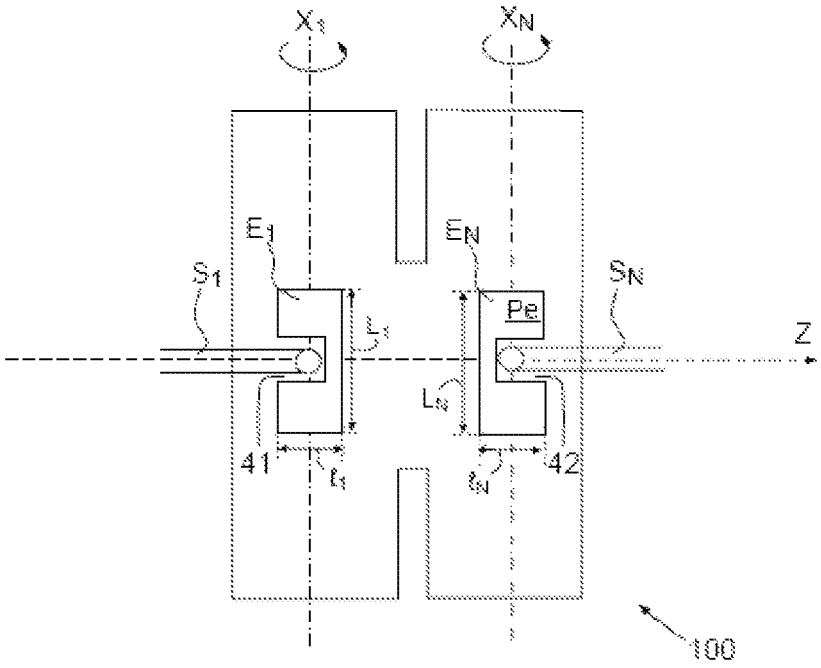

FIGS. 4A and 4B describes a band-pass filter 100 that can be frequency-tuned according to one aspect of the invention. The microwave is propagated along an axis Z.

As illustrated in FIG. 4A, the filter 100 comprises an input resonator R1 comprising a metal input cavity C1 and an input dielectric element E1, placed inside the cavity. The dielectric element E1 is capable of disrupting the resonance mode of the microwave in the input cavity. The intrinsic nature of the mode, corresponding to the resonance mode of the cavity without the dielectric element, is not modified, but the mode of the cavity is very disrupted by the addition of the dielectric element E1. The element E1 adds a capacitive effect which disrupts the resonance mode of the microwave in the cavity and modifies the resonance frequency of the initial resonator formed by the cavity without the dielectric element.

As illustrated in FIG. 4A, filter 100 also comprises an output resonator RN comprising a metal output cavity CN and an output dielectric element EN placed inside the cavity CN. The output dielectric element EN has the same properties as those of the input dielectric element E1.

Advantageously, a TM mode is chosen on which it is easier to obtain a capacitive effect. Specifically, it is possible to approximate the frequency behaviour of a resonator by an equivalent electric circuit: a resistance-capacitance-inductance (RLC resonator) parallel association. This circuit has a resonance frequency that is a function of the product L.C. When the capacitive effect is varied, the resonance frequency varies.

For the TM mode chosen, it is easy to add a capacitive effect by increasing the permittivity at the center of the resonator (location of the field lines E that are strongest) as described below.

In order to allow the microwave to penetrate the input cavity C1, the filter 100 comprises an input excitation means S1 of elongate shape on the axis Z penetrating the input cavity C1. This excitation means is typically a probe, such as a coaxial probe, of elongate shape, such as a cable.

In order to allow the microwave to exit the output cavity CN, the filter 100 comprises an output excitation means SN of elongate shape on the axis Z penetrating the output cavity CN. This excitation means is typically a probe, such as a coaxial probe, of elongate shape, such as a cable.

The input and output cavities are coupled together and coupled respectively to the input and output excitation means, so that the microwave inserted by the input excitation means into the filter 100 is propagated in the resonators according to a resonance mode and comes out of the filter again.

The input and output dielectric elements according to the invention have a specific shape which has a recess.

As illustrated in FIG. 4B, the input excitation means penetrates the recess 41 of the input dielectric element so that the input dielectric element disrupts the electromagnetic field close to the input excitation means.

As illustrated in FIG. 4B, the output excitation means penetrates the recess 42 of the output dielectric element so that the output dielectric element disrupts the electromagnetic field close to the output excitation means.

Because of the existence of this disruption, the central frequency of the filter is modified.

Moreover, the input dielectric element is capable of carrying out a rotation about an input rotation axis X1, the recess being suitable for allowing the rotation of the dielectric element while keeping the input excitation element inside the recess. Similarly, the output dielectric element is capable of carrying out a rotation about an output rotation axis XN, the recess being suitable for allowing the rotation of the dielectric element while keeping the output excitation element inside the recess.

Keeping the excitation element inside the recess makes it possible to maintain a strong disruption of the electromagnetic field in the vicinity of the element while ensuring a controlled coupling between excitation and resonator. This is essential to the control of the bandwidth and for the adaptation of the filter.

The distance between the excitation elements S1, SN and the respective dielectric elements E1, EN inside the recess is chosen as a function of the desired filter. A filter with large bandwidth requires a strong coupling and hence as short a distance as possible, limited by the mechanical manufacturing tolerances and the costs, typically about a hundred μm. A filter with narrow bandwidth requires a weaker coupling and hence a slightly greater distance, typically from 1 to a few mm. The rotations of the dielectric elements modify the capacitive effect, disrupting the electric field in a different manner depending on the angular position of the dielectric elements.

According to a preferred mode, the filter operates for a TM mode. For a TM mode, the magnetic field is perpendicular to the direction of propagation Z and the electric field E is colinear with Z. The preferred TM mode is of the $TM_{010}$ type. In a mode of this type, the maximum of the electric field E is concentrated at the center of the cavity of the resonator. According to a preferred mode, the cavities of the resonators of the filter according to the invention are aligned, and the direction Z corresponds to the axis passing through the center of the cavities. The maximum of field E is concentrated in the vicinity of Z. The capacitive effect induced by the presence of a disrupting dielectric is a function of the quantity of dielectric material (dielectric permittivity) "seen" by the field E. An increase in the quantity of dielectric "seen" by the electric field increases the capacitive effect of the resonator. The contrast obtained on the capacitive effect is maximized when this variation is located on a maximum of electric field.

For each dielectric element, a plane Pe is defined. This plane is perpendicular to a height h (h1 or hN) of the dielectric element as illustrated in FIG. 4A. When each plane Pe of the dielectric elements is generally perpendicular to Z, the quantity of material traversed by the field E in the vicinity of Z is much smaller than when the planes Pe of the dielectric elements comprise the axis Z. A high contrast of capacitive effect between the two positions is obtained, which induces a greater variation of central frequency of the filter.

Figure 5:
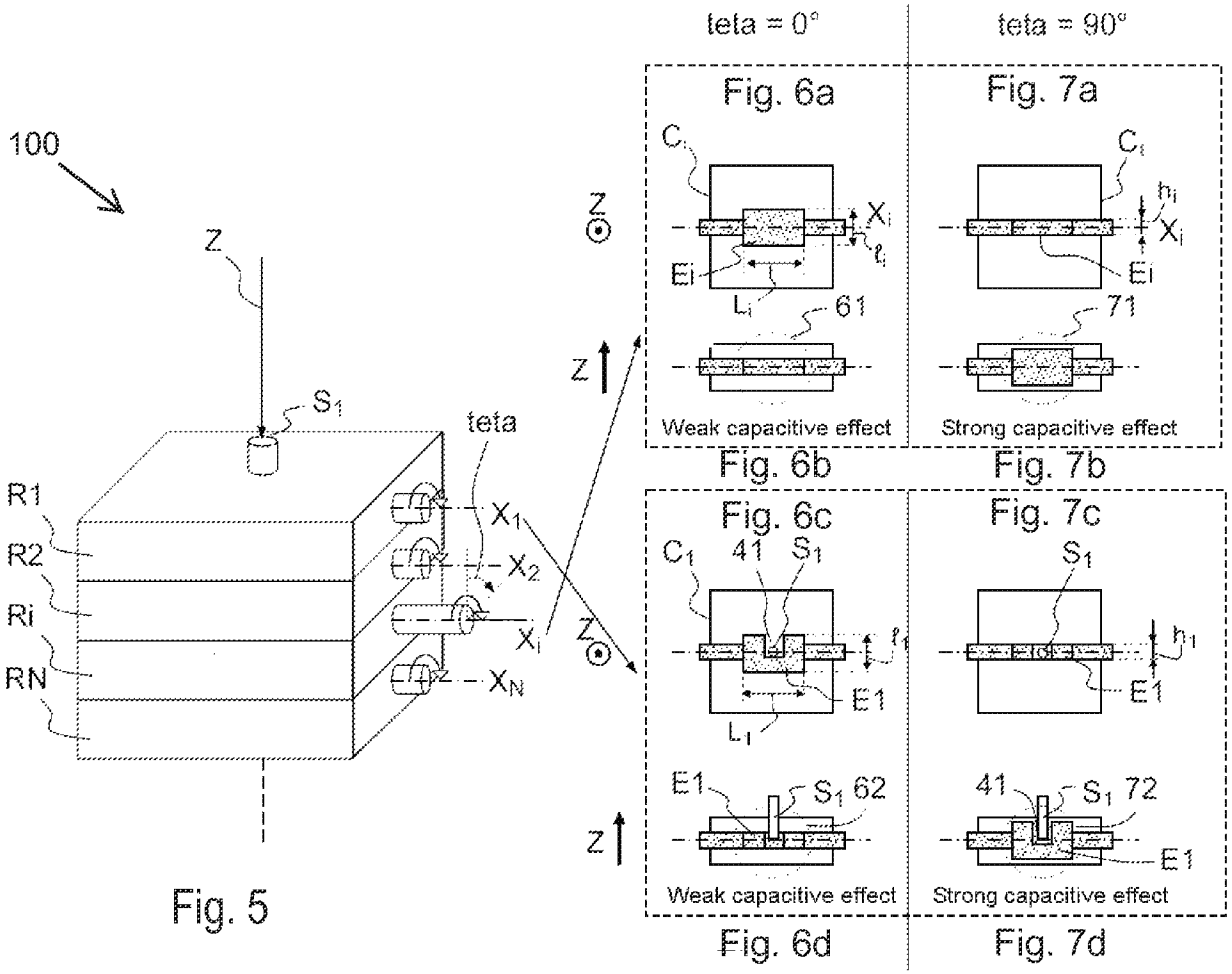
FIG. 5 describes a filter according to one aspect of the invention seen in perspective.

The rotation of a dielectric element is carried out at an angle teta relative to a given reference frame, for example an angle teta as illustrated in FIG. 5 described in more detail below). Thus the value of the central frequency of the filter fc is a function of an angle that the element E1 makes, and of an angle that the element E2 makes relative to the give reference frame.

Thus, a central frequency corresponds to an angular position of the dielectric elements.

The dielectric element E1 has a flat shape having respectively a height h1, as illustrated in FIG. 4A, that is smaller than the external dimensions in a plane Pe perpendicular to the direction supporting the height h1. "External dimensions" means the largest dimensions (l1 and L1, in the example of FIG. 4B) of the dielectric elements not taking account of the recess.

The dielectric element EN has a flat shape having respectively a height hN as illustrated in FIG. 4A, that is smaller than the external dimensions (such as lN and LN illustrated in FIG. 4B) in a plane Pe perpendicular to the direction along the height hN.

This flat shape makes it possible to obtain an amplitude of the variation of capacitive effect between the extreme angular positions of the dielectric elements, as described above. In order to obtain an amplitude of variation of capacitive effect that is sufficient for the target applications, the height is less by at least a factor of 3 than the smallest dimension in the plane Pe perpendicular to the direction supporting the height.

According to a preferred variant, the elements E1 and EN carry out an identical rotation. FIG. 7A describes an example of a filter according to the invention when E1 and EN make an identical angle teta0, and equal to 0° by convention, corresponding to a central frequency value fc0. FIG. 7B describes the filter according to the invention when E1 and E2 make an identical angle teta90, and equal to 90° relative to the first position of E1 and E2, corresponding to a central frequency value fc90.

Thus, when the dielectric elements E1 and EN have their plane Pe substantially perpendicular to the axis Z (heights h1, hN along the axis Z corresponding to teta=0°), the height of dielectric seen by the field E (at the centre, where it is strongest) is weaker than when the dielectric elements have their plane Pe comprising substantially the axis Z (heights h1, hN perpendicular to Z corresponding to teta=90°). Thus, the capacitive effect is weaker for the position of dielectric elements according to teta=0° than for the position teta=90°.

Therefore, the filter according to the invention is a bandpass filter of which the central frequency can be chosen in a frequency range as a function of the angular orientation of the dielectric elements. Moreover, the central frequency can be chosen continuously according to a span of variation of the angle of orientation of each dielectric element.

A correction (readjustment of the central frequency) as a function of the temperature is possible.

According to one embodiment, the adjustment of the angular positions is carried out with the aid of control means, such as a motor.

According to a preferred variant, the input dielectric element E1 and the output dielectric element EN are placed respectively substantially at the center of the input cavity and of the output cavity. This then gives a maximum concentration of the electric field in the vicinity of the input and output excitation means, which makes it possible to ensure the sufficient and controlled coupling of the excitations with the resonators 1 and N.

According to a preferred variant, the input dielectric element E1 and the output dielectric element EN are U-shaped. The shape comprises a body and two branches so as to produce a recess 41 or 42; the dielectric elements are thus easy to manufacture. There is no requirement of flatness on the shape of the dielectric elements.

According to one embodiment, the input and output excitation means are coaxial probes placed along one and the same axis Z.

According to one aspect of the invention, the filter comprises only two resonators, the input resonator R1 and the output resonator RN. The two resonators are coupled together by coupling means, such as one or more slots. According to a preferred variant, the input dielectric E1 and output dielectric EN are substantially identical in shape and material.

FIG. 5 describes a preferred embodiment of one aspect of the invention for which the filter 100 comprises, amongst other things, at least one intermediate resonator Ri, a resonator being numbered according to an index i varying from 2 to N−1, as a function of the number of intermediate resonators. FIG. 5 describes a view in perspective of the filter. The filter 100 includes an input means S1 extending along the axis Z, and resonators Ri, R1, R2, and RN, and rotation axes Xi, X1, X2, XN that extend through the resonators Ri, R1, R2, and RN respectively.

As illustrated in FIGS. 6A and 7A, the intermediate resonator Ri illustrated in FIG. 5 comprises an intermediate metal cavity Ci and an intermediate dielectric element Ei placed inside the cavity Ci and capable of disrupting the resonance mode of the microwave in the cavity, the dielectric element Ei being capable of carrying out a rotation about the intermediate rotation axis Xi.

According to a preferred variant, each intermediate dielectric element Ei also has a flat shape having a height hi as illustrated in FIGS. 6A and 7A, that is less than the external dimensions Li and li which are illustrated for example in FIG. 4B as L1, l1, LN, and lN (where li<Li for example in FIG. 5) in a plane Pe perpendicular to the direction along the height hi. In order to obtain sufficient variation amplitude of capacitive effect for the target applications, the height hi is less by at least a factor of 3 than the smallest dimension li in the plane Pe perpendicular to the direction along the height hi.

As illustrated in FIGS. 6A-6D and 7A-7D, the intermediate dielectric elements have a solid flat shape which does not necessarily have a recess because they are coupled together and not to an excitation element of elongate shape like the input and output dielectric elements.

The resonators are coupled two by two i/i+1 in series, by coupling means such as slots. These slots make it possible to couple both a portion of the electric field E and a portion of the magnetic field H. A coupling by field E has a sign opposite to a coupling by field H. In identical proportions, the two couplings cancel out. When the adjacent dielectric elements Ei/Ei+1 are rotated, for a given position and a given slot dimension, the coupling by field E (or H) varies.

According to a variant, the positions and the dimensions of the slots are determined by optimization such that the resultant bandwidth is substantially constant when the dielectric elements are rotated.

The input means S1 (FIGS. 6C, 6D, 7C, 7D) is a coaxial probe.

FIGS. 6A and 6B respectively illustrate a top view (i.e. a view from above the filter 100 illustrated in FIG. 5 in a direction along the axis Z) and a profile view (i.e. a view of a side of the filter 100 in a direction perpendicular to the axis Z) of the intermediate resonator Ri of the filter 100 illustrated in FIG. 5, in which the intermediate dielectric element Ei of the intermediate resonator Ri is positioned in a first angular position (teta=0°). FIGS. 6C and 6D respectively illustrate a top view and a profile view of the input resonator R1 of the filter 100 illustrated in FIG. 5, where the input dielectric element E1 of the input resonator R1 is positioned in the first angular position (teta=0°). FIGS. 7A and 7B respectively illustrate a top view and a profile view of the intermediate resonator Ri of the filter 100 illustrated in FIG. 5, where the intermediate dielectric element Ei of the intermediate resonator Ri is positioned in a second angular position (teta=90°). FIGS. 7C and 7D respectively illustrate a top view and a profile view of the input resonator R1 of the filter 100 illustrated in FIG. 5, where the input dielectric element E1 of the input resonator R1 is positioned in the second angular position (teta=90°).

According to a preferred variant, the rotation axes from X1, X2 . . . Xi to XN are parallel with one another as illustrated in FIG. 5.

As shown in FIG. 5, the rotation axes from X1, X2 . . . Xi to XN are perpendicular to the axis Z.

According to another variant of an embodiment of the present disclosure not shown, the rotation axes X1, X2 . . . Xi to XN may be concurrent with the axis Z.

Advantageously, the intermediate elements that are symmetrical relative to the medium of the filter are identical in shape, dimension and material.

Advantageously, the intermediate elements Ei are substantially identical in shape, dimension and material.

In this geometry, the filter is easier to compute and to manufacture.

The rectangular shape of the dielectric elements shown is purely schematic and does not correspond to a preferred shape.

As discussed above, FIGS. 6A-6D illustrate views of the structures of the dielectric elements Ei, E1 for which respective angular positions correspond to a value of teta=0°. FIG. 6A illustrates a top view of the intermediate dielectric element Ei in a cavity Ci of the intermediate resonator Ri, and FIG. 6B illustrates a profile view of the intermediate dielectric element Ei. A zone within dotted line 61 shown in FIG. 6B corresponds to an area of a configuration of the intermediate resonator Ri in which a respective capacitive effect is weak. FIG. 6C illustrates a top view of the input dielectric element E1 in the cavity C1 of the input resonator R1, and FIG. 6D illustrates a profile view of the input dielectric element E1. A zone within dotted line 62 shown in FIG. 6D corresponds to an area of a configuration of the input resonator R1 in which a respective capacitive effect is weak. In FIG. 6C, the recess 41 and the U shape of the input dielectric element E1 are visible. A central frequency value fc0 of the filter 100 is associated with the first angular position (teta=0°), corresponding to the dielectric elements Ei, E1 positioned perpendicularly to the axis Z.

As discussed above, FIGS. 7A-7D illustrate views of the structures of the dielectric elements Ei, E1 for which respective angular positions correspond to a value of teta=90°. FIG. 7A illustrates a top view of the intermediate dielectric element Ei in a cavity Ci of the intermediate resonator Ri, and FIG. 7B illustrates a profile view of the intermediate dielectric element Ei. A zone within dotted line 71 shown in FIG. 7B corresponds to an area of a configuration of the intermediate resonator Ri in which a respective capacitive effect is strong. FIG. 7C illustrates a top view of the input dielectric element E1 in the cavity C1 of the input resonator R1, and FIG. 7D illustrates a profile view of the input dielectric element E1. A zone within dotted line 72 shown in FIG. 7D corresponds to an area of a configuration of the input resonator R1 in which a respective capacitive effect is strong. In FIG. 7D the recess 41 and the U shape of the input dielectric E1 can be seen. A central frequency value fc90 of the filter 100 is associated with the second angular position (teta=90°).

Intermediate central frequencies are obtained for values of teta of between 0° and 90°.

Preferably, all the dielectric elements E1, Ei, EN have an identical angular position corresponding to an identical rotation, a value of the angle of rotation teta corresponding to a value of central frequency:

$$fc=f(\text{teta})$$

A progressive and synchronous rotation of the dielectric elements E1, Ei, EN makes it possible to continuously vary the central frequency fc of the filter.

To obtain a change of central frequency when the disrupting elements E1, Ei, EN are rotated, none of these elements has symmetry of revolution about its respective rotation axis.

Thus the rotation made by each dielectric element E1, Ei, EN varies the quantity of material traversed by the electric field E at the centre of the cavities of the resonators, which has the effect of varying the capacitive effect of the resonator.

FIGS. 8A-8C and FIGS. 9A-9C illustrate an exemplary embodiment of a filter according to the invention and the filter characteristics obtained.

Figure 8A:
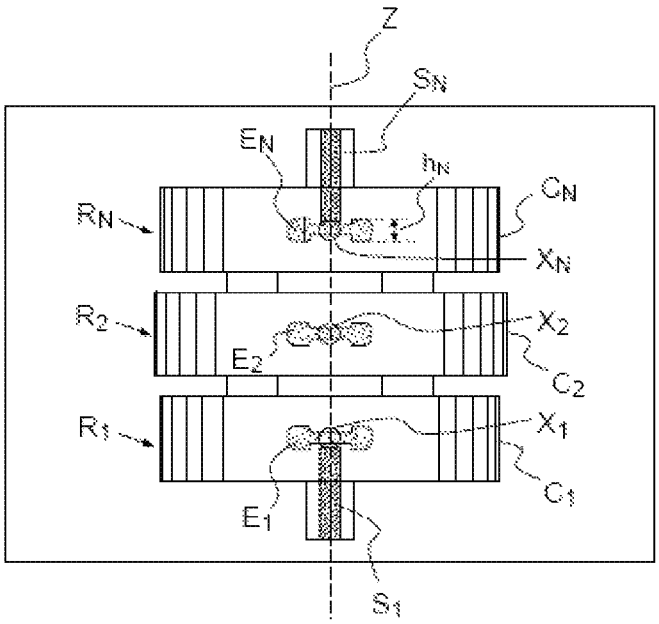
FIG. 8A illustrates an elevation view of an exemplary embodiment of a filter according to one aspect of the invention comprising three resonators, for a determined value of angle of rotation.
Figure 8B:
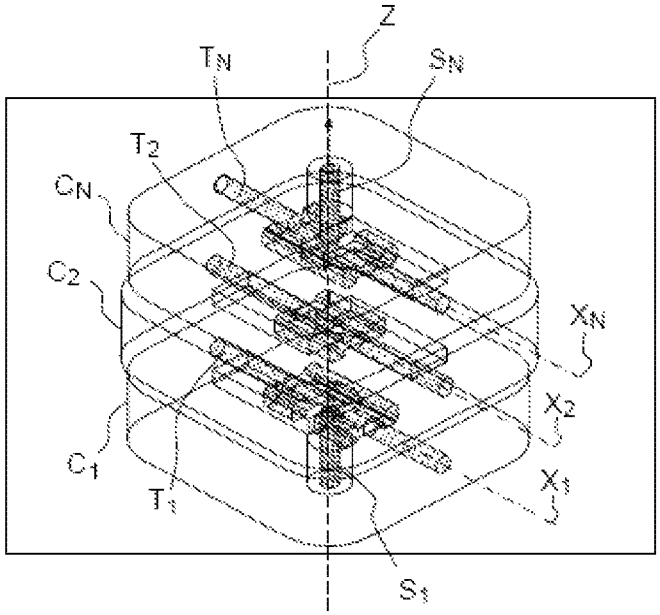
FIG. 8B illustrates an perspective view of the filter of FIG. 8A.
Figure 9C:
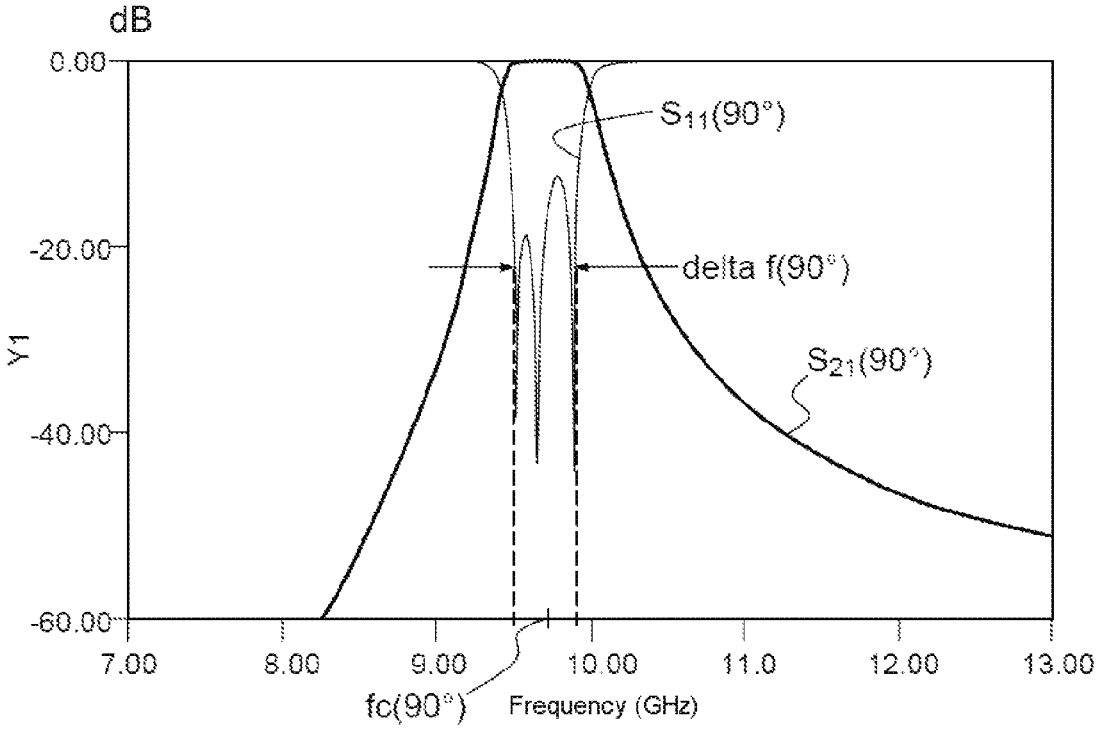
FIG. 9C illustrates a frequency curve for the filter of FIG. 9A.
Figure 9A:
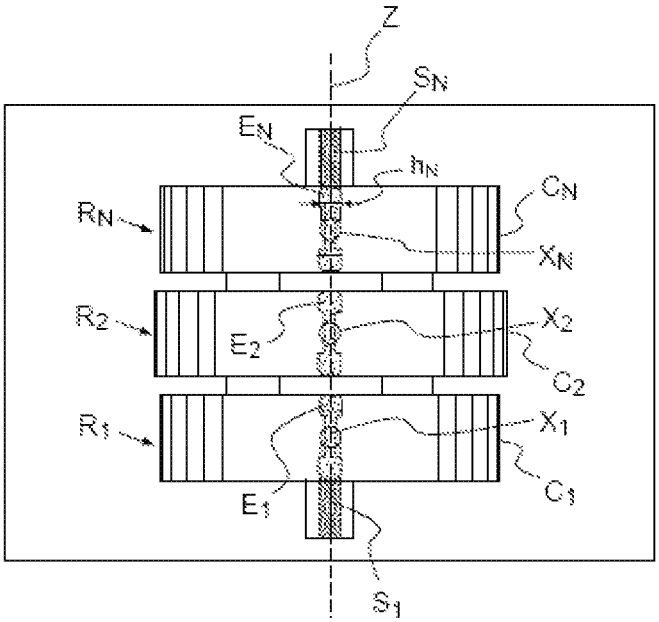
FIG. 9A illustrates the exemplary embodiment of the filter described in FIGS. 8A-8C for another determined value of angle of rotation.
Figure 9B:
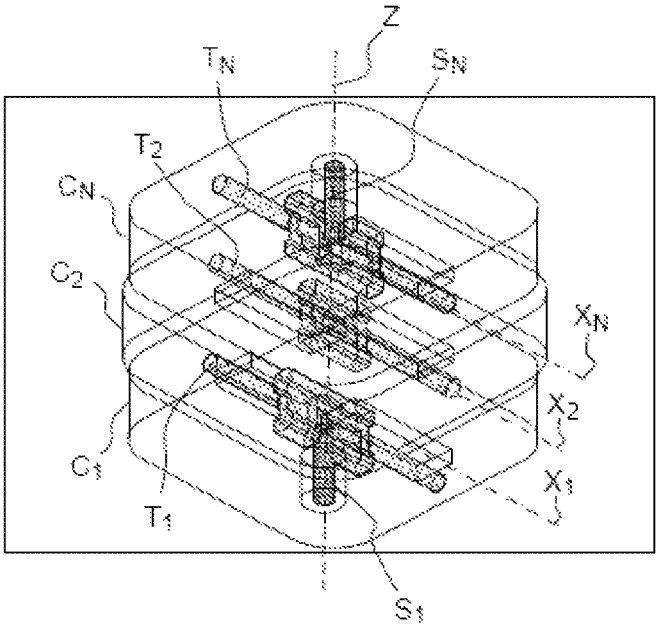
FIG. 9B illustrates a perspective view of the filter of FIG. 9A.

As illustrated in FIGS. 8A and 9A, filter comprises 3 resonators R1, R2, RN comprising cavities C1, C2, CN of substantially square shape as illustrate in FIGS. 8B and 9B.

The dimension of the cavities C1 and CN is 16 mm, the dimension of C2 is 17 mm. The 3 cavities have a height of 4.5 mm.

The dielectric elements E1, E2, EN as illustrated in FIGS. 8A and 9A are made of zirconia. The input dielectric element E1 and output dielectric element EN have a dimension of 3.8 mm×6.1 mm×1.2 mm. The height h of 1.2 mm is less than the other dimensions by approximately a factor of 3 with the smallest of the two other dimensions.

The dimensions of the intermediate dielectric element E2 are 4 mm×4.1 mm×1.2 mm (height h of 1.2 mm).

The resonators R2 and RN are connected by two slots of dimension 7 mm×2.5 mm, 5.5 mm apart. Screws not shown (6 per cavity) allow a fine adjustment of the resonance of the TM mode and of the couplings.

FIG. 8A corresponds to an angle value teta=0°, the elements are generally perpendicular to the axis Z (height h extends along axis Z, plane Pe perpendicular to axis Z), corresponding to a weak capacitive effect. FIG. 8A represents a view in profile of the filter and FIG. 8B a view in perspective.

FIG. 9A corresponds to an angle value teta=90° of angle of rotation of the dielectric elements, the elements are generally parallel to the axis Z (height h perpendicular to Z, plane Pe comprising the axis Z), corresponding to a strong capacitive effect. FIG. 9A represents a view in profile of the filter and FIG. 9B a view in perspective.

In this example, the flat shapes of the dielectric elements are optimized to maximize the difference of capacitive effect and hence of the frequency shift.

According to a preferred variant shown in FIGS. 8A, 8B, 9A, and 9B, the dielectric elements E1, E2, EN are secured to retention means, preferably respective rods T1, T2, TN also made of dielectric material capable of carrying out a rotation. In addition, input means S1 is positioned relative to resonator R1, and input means SN is positioned relative to resonator RN.

Advantageously, a rod and the dielectric element that is secured to it form a single block of one and the same dielectric material which is manufactured in one piece. In this case, and more generally when the rod is made of dielectric material, it contributes to the disrupting effect of the dielectric element. Preferably the rods Ti pass right through the associated disrupting element Ei and the cavity Ci, which ensures a better mechanical retention of the dielectric element in the cavity than with a single retention point.

These rods may carry out a rotation on the corresponding rotation axis X1, X2, XN with the aid of a pivot connection with the walls of the cavity C1, C2, CN in which they are found. There are therefore fewer technological steps for the manufacture of the filter.

Figure 8C:
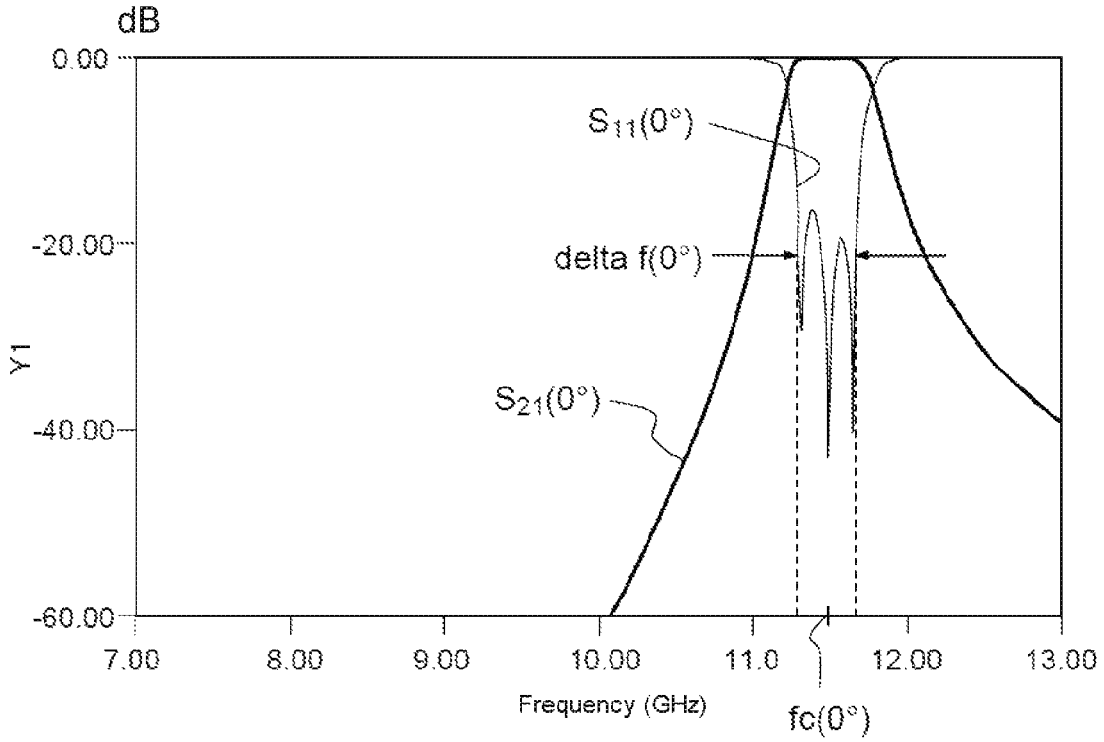
FIG. 8C illustrates a frequency curve for the filter of FIG. 8A.

FIG. 8C illustrates the frequency behavior (Y1 in dB versus frequency in GHz) of the band-pass filter obtained for teta=0°. The curve S21(0°) corresponds to the transmission of the filter and the curve S11(0°) to the reflection. The bandwidth at −20 dB is deltaf(0°) and the central frequency fc(0°) is equal to 11.5 GHz.

FIG. 9C illustrates the frequency behavior (Y1 in dB versus frequency in GHz) of the band-pass filter obtained for teta=90°. The curve S21(90°) corresponds to the transmission of the wire and the curve S11(90°) to the reflection. The bandwidth at −20 dB is deltaf(90°) and the central frequency fc(90°) is equal to 9.65 GHz.

Thus, by rotation through an angle of 90°, the central frequency is modified from 9.65 GHz to 11.5 GHz.

Figure 10A:
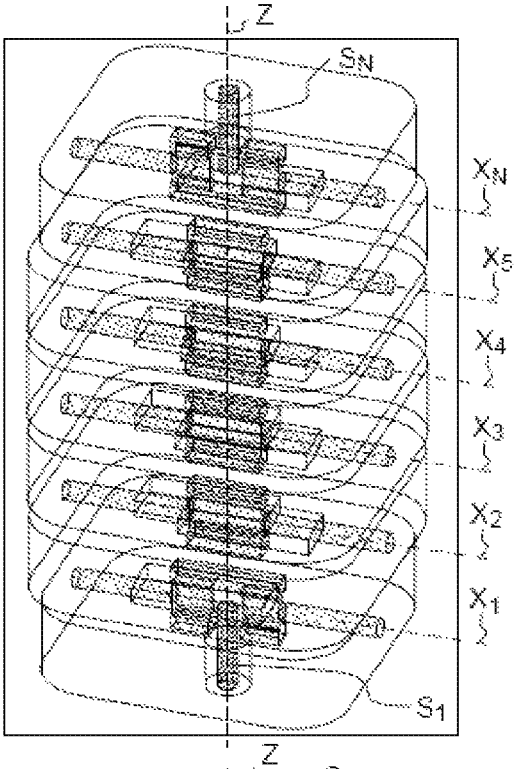
FIG. 10A illustrates an exemplary embodiment of a filter according to one aspect of the invention comprising six resonators for a determined value of angle of rotation.
Figure 10B:
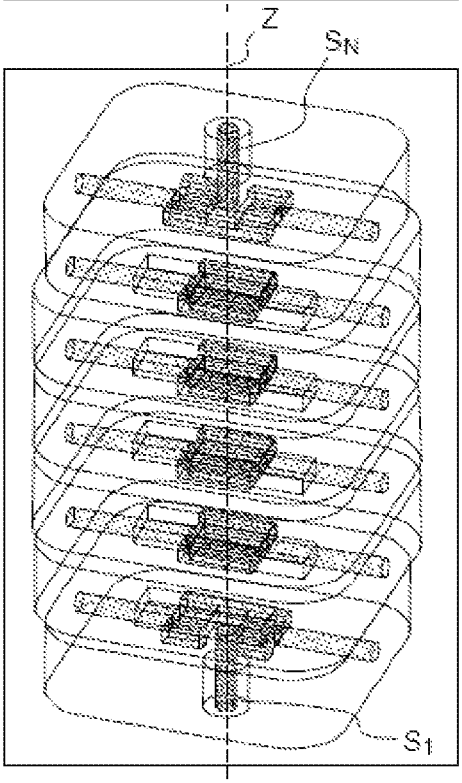
FIG. 10B illustrates a perspective view of the filter of FIG. 10A.
Figure 10C:
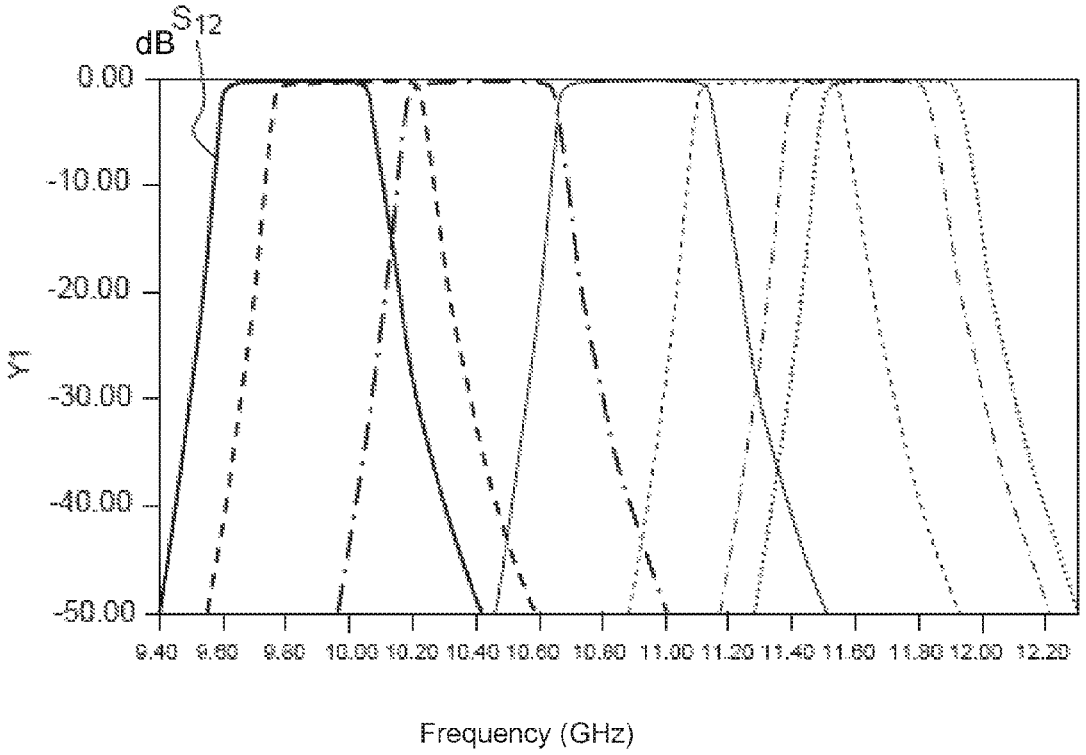
FIG. 10C illustrates a frequency curve for the filter of FIG. 10B.

FIGS. 10A and 10B illustrate another embodiment of a filter according to the invention in the same spirit as the filter described in FIGS. 8A-8C and FIGS. 9A-9C. FIG. 10A describes a view in perspective of the filter for dielectric elements that are generally parallel to the axis Z and FIG. 10B describes a view in perspective of the filter for the dielectric elements that are generally perpendicular to the axis Z. The filter comprises 6 resonators, and a rotation axis X1, X2, X3, X4, X5, and XN respectively extending through each resonator. FIG. 10C illustrates a frequency curve (Y1 in dB versus frequency in GHz) which describes the transmission of the filter S12 for various angular positions of the dielectric elements between 0° and 90°. The central frequency varies as a function of the angle of inclination of the dielectric elements, between 9.65 GHz and 11.5 GHz.

The adaptation is of the order of 15 dB and the losses of the filter between 0.3 and 0.5 dB irrespective of the value of the angle of rotation.

For the filters according to the invention, the input and the output play a symmetrical role.

The variations in temperature (typically a few tens of degrees) in the filter induce fluctuations in the dimensions of the cavities and of the dielectric elements, which generates variations of central frequency for one and the same filter geometry.

According to one embodiment of the filter according to the invention, angles of rotation of the dielectric elements have values that can be varied as a function of the temperature so as to correct the effects of the temperature on the central frequencies and hence keep the values of these central frequencies constant during a variation in temperature.

Preferably, each value of central frequency corresponds to an angle of rotation that is identical for all the dielectric elements of the filter according to the invention and the value of this angle is temperature-controlled so as to keep the central frequency at a determined value independent of the temperature.

According to another aspect, the invention also relates to a microwave circuit comprising at least one filter according to the invention.

The invention claimed is:

1. A band-pass filter that can be frequency-tuned, has a central frequency, and includes an axis along which a microwave is propagated, the band-pass filter comprising:

an input resonator including a metal input cavity and an input dielectric element placed inside the metal input cavity, the input dielectric element being capable of disrupting a resonance mode of the microwave in the metal input cavity, an output resonator comprising a metal output cavity and an output dielectric element placed inside the metal output cavity, the output dielectric element being capable of disrupting the resonance mode of the microwave in the metal output cavity, an input excitation means of elongate shape positioned along the axis and penetrating the metal input cavity in order to allow the microwave to penetrate the metal input cavity, an output excitation means of elongate shape positioned along the axis and penetrating the metal output cavity in order to allow the microwave to exit the metal output cavity, wherein the input resonator is coupled to the output resonator, wherein each of the input dielectric element and the output dielectric element have a recess, wherein the input excitation means penetrates the recess of the input dielectric element so that the input dielectric element disrupts an electromagnetic field close to the input excitation means, wherein the output excitation means penetrates the recess of the output dielectric element so that the output dielectric element disrupts the electromagnetic field close to the output excitation means, wherein the input dielectric element is capable of carrying out a rotation about an input rotation axis, the recess of the input dielectric element being suitable for allowing the rotation about the input rotation axis of the input dielectric element while keeping the input excitation means inside the recess of the input dielectric element, wherein the output dielectric element is capable of carrying out a rotation about an output rotation axis, the recess of the output dielectric element being suitable for allowing the rotation about the output rotation axis of the output dielectric element while keeping the output excitation means inside the recess of the output dielectric element, wherein the input dielectric element has a flat shape having a height that is less than a smallest one of at least 2 external dimensions of the input dielectric element in a plane perpendicular to a direction along the height of the input dielectric element by at least a factor of 3, wherein the output dielectric element has a flat shape having a height that is less than a smallest one of at least 2 external dimensions of the output dielectric element in a plane perpendicular to a direction along the height of the output dielectric element by at least a factor of 3, and wherein the rotation about the input rotation axis of the input dielectric element and the rotation about the output rotation axis of the output dielectric element allow modifications of the central frequency of the band-pass filter.

2. The band-pass filter according to claim 1, in which the input dielectric element is placed substantially at a center of the metal input cavity and the output dielectric element is placed substantially at a center of the metal output cavity.

3. The band-pass filter according to claim 1, wherein each of the input dielectric element and output dielectric element are U-shaped.

4. The band-pass filter according to claim 3, wherein at least one of the input dielectric element and the output dielectric element is defined to have a U shape in a plane containing a respective rotation axis, and wherein the U shape defines a fixed thickness corresponding to a respective height along an axis perpendicular to the plane containing the respective rotation axis.

5. The band-pass filter according to claim 1, further comprising at least one intermediate resonator placed in series between the input resonator and the output resonator, wherein the at least one intermediate resonator includes at least an intermediate metal cavity and an intermediate dielectric element placed inside the intermediate metal cavity, the intermediate dielectric element being capable of disrupting the resonance mode of the microwave in the intermediate metal cavity, wherein the intermediate dielectric element has a flat shape having a height that is less than a smallest one of at least 2 external dimensions of the intermediate dielectric element in a plane perpendicular to a direction along the height of the intermediate dielectric element by at least a factor of 3, wherein the intermediate dielectric element is capable of carrying out a rotation about an intermediate rotation axis, and wherein the band-pass filter includes coupling means suitable for coupling the at least one intermediate resonator in series.

6. The band-pass filter according to claim 5, wherein the coupling means are slots.

7. The band-pass filter according to claim 5, wherein the intermediate dielectric element includes at least two intermediate dielectric elements that are substantially identical in shape and size.

8. The band-pass filter according to claim 1, wherein the input rotation axis is parallel to the output rotation axis.

9. The band-pass filter according to claim 1, wherein the input rotation axis and the output rotation axis are perpendicular to the axis.

10. The band-pass filter according to claim 1, wherein the input dielectric element has a first angular position corresponding a first rotation about the input rotation axis that is identical to an a second angular position of the output dielectric element corresponding to a second rotation about the output rotation axis, and wherein a respective value of an angle of rotation of the first angular position and the second angular position corresponding to a value of the central frequency of the band-pass filter.

11. The band-pass filter according to claim 1, wherein each of the input dielectric element and the output dielectric element is secured to a respective dielectric rod capable of carrying out a respective rotation on a corresponding one of the input rotation axis and the output rotation axis.

12. The band-pass filter according to claim 1, wherein respective angles of rotation of the input dielectric element and the output dielectric element about the input rotation axis and the output rotation axis are variable as a function of temperature so as to keep values of the central frequency constant when there is a variation in temperature.

13. A microwave circuit comprising at least one band-pass filter according to claim 1.

14. The band-pass filter according to claim 1, wherein the height of the input dielectric element corresponds to a dimension of the input dielectric element that is fixed along the input rotation axis, and wherein the height of the output dielectric element corresponds to a dimension of the output dielectric element that is fixed along the output rotation axis.

15. The band-pass filter according to claim 1, comprising respective coupling means suitable for coupling the input resonator and output resonator directly.

* * * * *